US005564343A

United States Patent [19]

Bartholomy et al.

[11] Patent Number: 5,564,343

[45] Date of Patent: Oct. 15, 1996

[54] PAINT COLORANT DISPENSING STATION SHELF

[75] Inventors: Erik G. Bartholomy, Westlake; Joseph N. Biber, Macedonia; Beverly A. Damko, Parma Heights; Norman A. Johansen, Medina; John E. Kurowicki, Lakewood; William A. McSwain, Rocky River; Lawrence C. Stanek, Akron; Robert E. West, Wadsworth, all of Ohio

[73] Assignee: ABC TechCorp, Akron, Ohio

[21] Appl. No.: 434,858

[22] Filed: May 4, 1995

[51] Int. Cl.[6] ..... A47B 85/00

[52] U.S. Cl. ..... 108/13; 108/62; 108/152

[58] Field of Search ..... 108/144, 13, 50, 108/28, 62, 102, 106, 138, 152

[56] References Cited

U.S. PATENT DOCUMENTS

| | | | |
|---|---|---|---|
| 848,466 | 3/1907 | Kendall | 108/62 |
| 1,012,856 | 12/1911 | Irving | 108/62 |
| 1,427,208 | 8/1922 | Happy | 108/69 |
| 2,248,276 | 7/1941 | Tourneau | 108/62 |
| 3,123,220 | 3/1964 | Hanson | 108/62 |
| 5,469,934 | 11/1995 | Pherigo | 108/152 |

*Primary Examiner*—Peter M. Cuomo
*Assistant Examiner*—Gerald A. Anderson
*Attorney, Agent, or Firm*—Renner, Kenner, Greive, Bobak, Taylor & Weber

[57] ABSTRACT

An adjustable shelf for a paint colorant dispensing station comprises at least two platforms rotatably mounted on a pair of brackets. A pair of stops restrain the rotation of the shelf between two positions. One of the platforms is substantially horizontal and disposed beneath a dispensing head in one of the positions. The other platform is substantially horizontal and disposed beneath the dispensing head in the other of the positions. Each platform is adapted to hold a paint can. Each stop is adjustable by rotating the stop relative to the shelf. The rotation causes a threaded rod to extend from or retract to the element that supports the stop. A locking mechanism is provided to selectively restrain the shelf against rotation when the shelf is in one of the two positions.

14 Claims, 3 Drawing Sheets

PAINT COLORANT DISPENSING STATION SHELF

TECHNICAL FIELD

The invention herein relates to the art of adjustable shelving and, more particularly, to an adjustable shelf in a paint colorant dispensing station that accommodates one gallon and five gallon paint cans.

BACKGROUND ART

Consumers desire paint to be available in a multitude of different colors. The number of different colors is so large that paint sellers cannot feasibly stock enough combinations to meet consumer demand. Thus, paint sellers typically mix paint at the point of sale to achieve a consumer's desired paint color. A specific color is achieved by mixing a pigment or colorant, or a combination thereof, with a base paint. When a customer requests a quantity of a specific paint color, the paint seller determines the correct volumes of the various colorants that must be combined with the required volume of base to create the specified paint color. The seller dispenses these colorants into the base and then mixes the combinations to create the desired paint color in the volume that the customer requested.

Paint is typically sold in either one gallon cans or five gallon cans. Industrial or professional customers who use large volumes of paint create the demand for five gallon cans while individuals create the demand for one gallon cans. Thus, a paint seller desires equipment that is capable of easily accommodating both paint can sizes. A paint seller also desires to be able to quickly and easily change the equipment from a configuration to accommodate one can size to another without using a tool. After a change has occurred, it is also desirable to have the equipment maintain the same integrity that it did before the change. In other words, system integrity should be independent of the equipment configuration.

To add colorant to a base paint, a can of base paint is placed below a dispensing head. The dispensing head and a controlled dispensing mechanism then dispense the correct amount of colorants into the base paint. During this process it is undesirable to require the operator to hold or support the can in any manner. It is desirable that the operator be free to perform other necessary tasks to assure proper colorant dispensing. It is also desirable to have the can opening as close to the dispensing head as possible to avoid splashing or spilling and to assure that the colorant goes into the can. A typical paint colorant dispensing station has a stationary shelf disposed below a dispensing head. The shelf is located far enough below the dispensing head so that the top of a standard five gallon can is immediately below the dispensing head. The short distance between the can opening and the dispensing head decreases the likelihood that colorant will miss the can opening or splash out of the can. This is particularly important because the volume of colorant that mixes with the base paint determines the resulting paint color. If part of the colorant misses the can, the resulting color will not be correct, thereby forcing the paint seller to repeat the process.

To add colorant to a one gallon can at a dispensing station having a stationary shelf, the operator must place the one gallon can on a lift. A lift is any object that is employed to position the opening of the one gallon can closer to the dispensing head. Without a lift, a one gallon can would be a significant distance below the dispensing head, increasing the likelihood that colorant would miss the can. Although a lift is functional, the lift must be stored while not in use. Furthermore, a lift increases the problem of stability. The operator has to be sure that the lift is secure and that the one gallon can is securely placed on top of the lift. It is therefore desirable to have one structure that can accommodate both a five gallon can and a one gallon can for positioning the cans directly below the dispensing head while colorants are dispensed and to do so in equally secure fashions.

DISCLOSURE OF THE INVENTION

In light of the foregoing, a first aspect of the present invention is to provide a colorant dispensing station with an adjustable shelf for accommodating one gallon and five gallon paint cans.

Another aspect of the present invention is to provide a colorant dispensing station that incorporates a shelf that is easily rotated between a first position and a second position.

A further aspect of the present invention is to provide a colorant dispensing station that incorporates a shelf that is selectively restrained in both a first position and a second position.

Yet another aspect of the present invention is to provide such a dispensing station that incorporates at least a pair of stops that serve to level and restrain the shelf that holds the paint cans.

A further aspect of the present invention is to provide a colorant dispensing station that incorporates a shelf that allows an operator to easily place cans on the shelf and remove cans from the shelf.

The foregoing and another aspects of the invention which will become apparent herein are achieved by a paint colorant dispensing station, comprising: a base; a pair of brackets connected to and extending from said base; a shelf rotatably connected to said pair of brackets; a dispensing head disposed above said shelf; first and second stops interposed between said base and said shelf; and locking means for selectively restraining said shelf against rotation.

Other aspects which will become apparent herein are achieved by a paint colorant dispensing station having a colorant dispensing head and an adjustable shelf maintained beneath the dispensing head, the adjustable shelf comprising: first and second platforms, each of said platforms adapted for receiving and for supporting a paint can; a pair of bracket means for rotatably supporting said platforms; first and second stops, each of said stops mounted such that the rotation of said shelf is restrained between two positions; and locking means for selectively restraining said platform against rotation.

BRIEF DESCRIPTION OF DRAWINGS

For a complete understanding of the objects, techniques, and structure of the present invention, reference should be made to following detailed description and accompanying drawings, wherein.

BEST MODE FOR CARRYING OUT THE INVENTION

Figure 1:
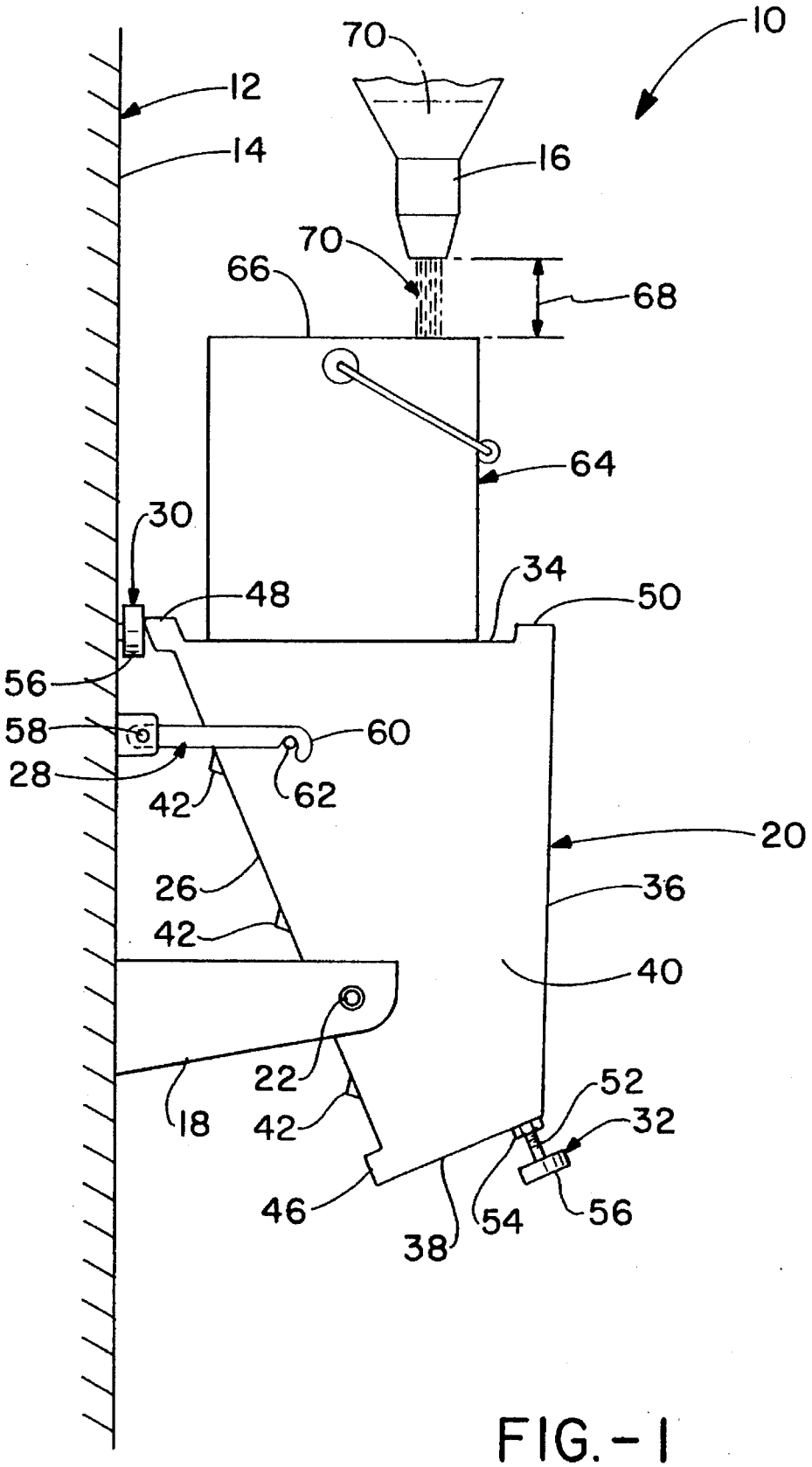
FIG. 1 side view of the paint colorant dispensing station where the shelf is in a first position.

Referring now to the drawings and more particularly to FIG. 1, it can be seen that a paint colorant dispensing station according to the invention is designated generally by the numeral 10. The paint colorant dispensing station 10 includes a base or cabinet 12 having a substantially vertical wall 14, a colorant dispensing head 16, a pair of brackets 18, and a rotatable shelf 20. In the preferred embodiment of the invention, the cabinet 12 houses reservoirs of colorant, pumps, and tubing for attaining paint tinting. The shelf 20 is rotatably connected to the pair of brackets 18 by pivot means 22. The pivot means may be a pair of studs, one at each bracket 18, or a single axle extending between the brackets 18. In the preferred embodiment, a support 24, shown in FIG. 2, extends from a five gallon can platform 26 to engage the pivot means 22. The station 10 further includes a locking mechanism 28 and pairs of adjustable stops 30, 32. One pair of stops 30 extends from the vertical wall 14 of the base 12 while the other pair of stops 32 extends from the shelf 20. Preferably, the pairs of stops 30, 32 are positioned within, but near the ends of the shelf 20.

Figure 2:
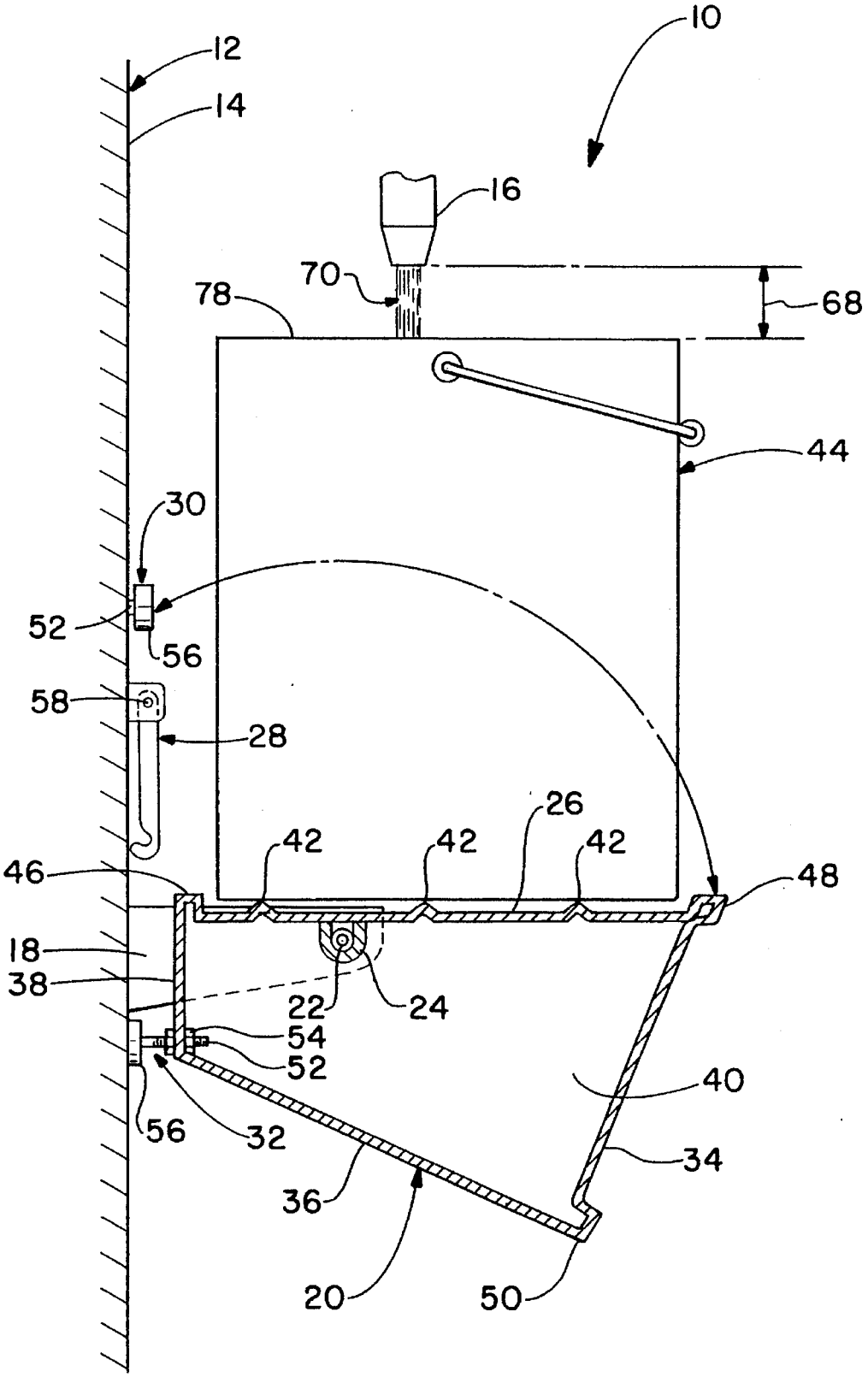
FIG. 2 is a cross-sectional side view of the paint colorant dispensing station where the shelf is in a second position.

The shelf 20 is constructed from a rigid material such as sheet metal. The brackets 18 are also constructed from a rigid material such that they can support the weight of the shelf 20 and a five gallon can of paint. The brackets 18 are placed a distance apart to accommodate a shelf 20 that is at least wide enough to accommodate a five gallon paint can. In the preferred embodiment, the shelf 20 has four sides 26, 34, 36, and 38, or platforms, that are connected to form a tube, having a generally quadrilateral cross section. A pair of end walls 40 cap each end of the shelf 20. A plurality of reinforcement ribs 42 are formed in the five gallon can platform 26 to stiffen the shelf 20 to support the five gallon can 44 as shown in FIG. 2. Various other stiffening devices or techniques may be employed, such as adding stiffening bars to the five gallon can platform 26, or forming stiffening channels at the connections between the sides 26, 34, 36, and 38 of the shelf 20 as shown at 46, 48, and 50. The ribs 42 may be formed by a variety of methods such as bending or pressing. The ribs 42 may also be covered with a material such as rubber to provide a non-slip surface on the platform 26 for receiving the five gallon can 44.

The pairs of adjustable stops 30, 32 are constructed such that each may be extended from or retracted to the surface where they are attached. One method of providing the required adjustments is to provide each stop 30, 32 with a threaded rod 52 that engages a pair of nuts 54, one nut on each side of the surface supporting the stop. The stop 30, 32 may then be rotated until the desired position is achieved. The nuts 54 are then tightened to lock the stop in place. Lock washers may be employed to further ensure the position of the nuts. In the preferred embodiment, the heads 56 of the stops 30, 32 have a hard rubber disk surrounding a metal base connected to the threaded rod 52.

Preferably, one pair of adjustable stops 30 is connected to the base 12 such that longitudinally opposed corners of the shelf 20 rest against the stops 30 when the shelf 20 is in a first position as depicted in FIG. 1. When the shelf 20 is in this position, a one gallon can platform 34 is essentially horizontal. The one gallon can platform 34 can be leveled by manipulating the adjustable stops 30. When the shelf 20 is in this position a locking mechanism 28 is employed to restrain the shelf 20 against clockwise rotation. One possible embodiment of the locking mechanism 28 is shown in FIG. 1 as a rod extending from the base 12 to the shelf 20. In this embodiment, the rod is pivotally mounted to the base or cabinet 12 at one end, as at 58, and has a hook 60 formed at the opposite end for engaging an "eye" or pin 62 connected to an end wall 40 or the shelf 20. The latch or locking mechanism 28 prevents the shelf 20 from rotating clockwise as viewed in FIG. 1. The locking mechanism 28 could also extend between the brackets 18 and the shelf 20. Other embodiments of the locking mechanism 28 are also possible as long as the latch or locking mechanism 28 restrains the shelf against rotation and is easily engaged and disengaged by an operator. Although a single lock mechanism 28 will typically be sufficient, it is contemplated that one such mechanism will be maintained at each end of the shelf 20.

When the shelf 20 is in the first position as shown in FIG. 1, a one gallon can 64 sits on the one gallon can platform 34. The one gallon can platform 34 is disposed at a distance below the dispensing head 16 such that the height of a standard one gallon can 64 places the top surface of the can 66 a short distance below the dispensing head 16. That distance, represented by numeral 68, is small enough to prevent splashing when colorant 70 is dispensed into the can 64 by the dispensing head 16. The small distance also prevents colorant 70 from missing the can 64. The space between the top surface of the can 66 and the dispensing head 16 is not so small that the can 64 cannot be easily removed.

Figure 3:
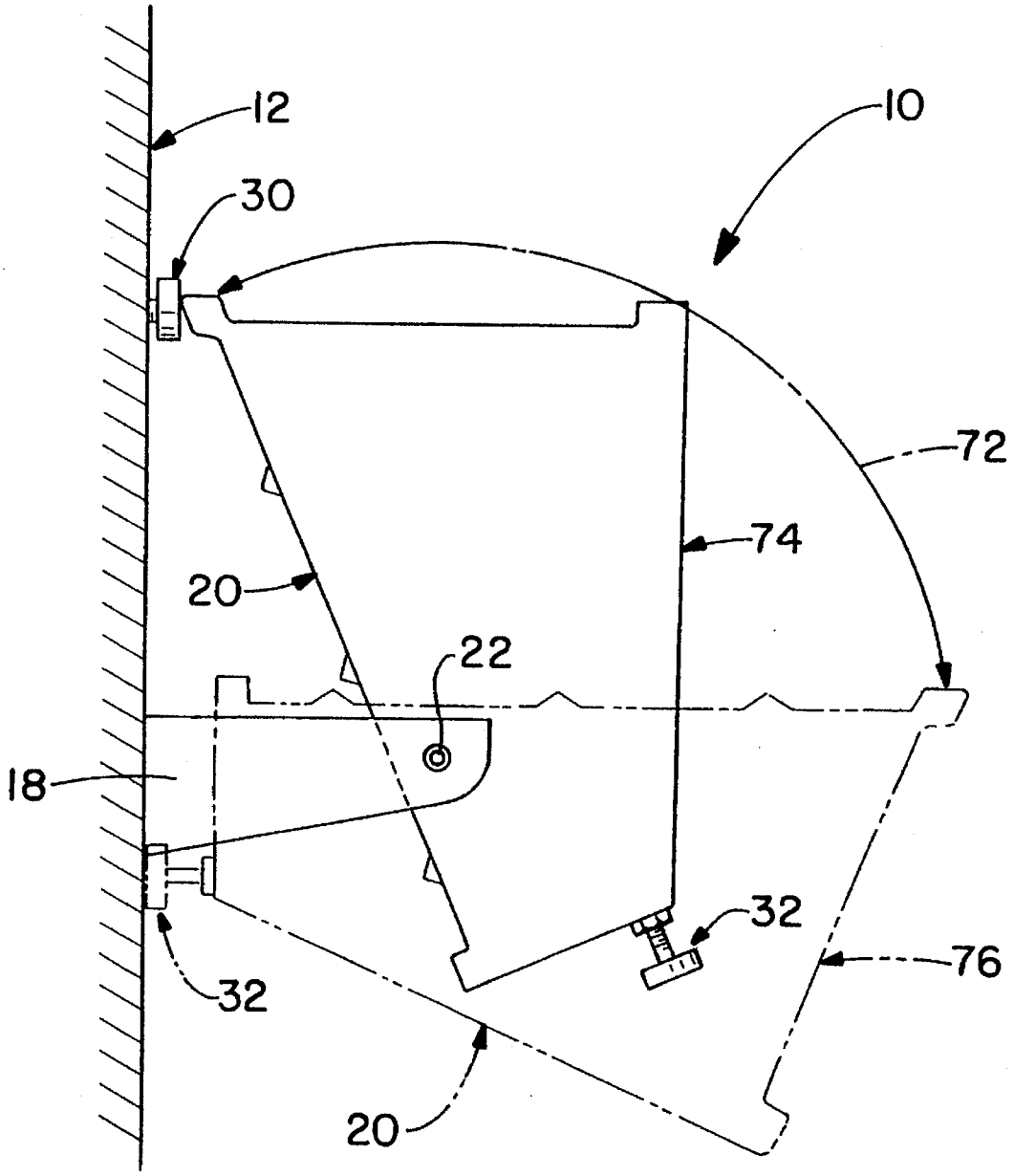
FIG. 3 is a side view of the paint colorant dispensing station showing the shelf's paths of rotation.

The second position of the shelf 20 is achieved by disengaging the locking mechanism 28 and rotating the shelf 20 clockwise until the stops 32 engage the vertical wall 14 of the cabinet or base 12, as shown in FIG. 2. The path of the shelf's rotation is shown in FIG. 3 by the numeral 72. Numeral 74 in FIG. 3 shows the shelf 20 while it rotates between the first and second positions. Numeral 76 shows the path of the shelf 20 as it travels from the second position to the first position.

The second position is shown in FIG. 2. The stops 32 are adjusted such that the five gallon can platform 26 is substantially horizontal when the stops 32 engage the base 12. In this position, the stops 32 function as restraining devices. A five gallon can 44 sits on the five gallon can platform 26 such that the top surface of the five gallon can 78 is approximately the same distance from the dispensing head 16 as the top surface of the one gallon can 66 was from the dispensing head 16 when received by the platform 34. This distance is represented by the numeral 68.

When an operator desires to add colorant to a paint can, the operator rotates the shelf 20 to either the first or second position. If the operator desires to add colorant to a one gallon can, the operator rotates the shelf 20 to the first position, shown in FIG. 1. The operator then engages the locking mechanism 28 such that the shelf 20 is restrained against rotation. The operator then places the one gallon can 64 onto the one gallon can platform 34 and activates the colorant dispensing head 16. If the operator then desires to add colorant to a five gallon can, the operator disengages the restraining device 28 and rotates the shelf 20 to the second position, shown in FIG. 2. The operator then places a five gallon can 44 on the five gallon can platform 26 and activates the dispensing head 16. In both positions, colorant may be added to the paint cans 44, 64 without the need for the operator to hold the cans. After colorant has been added to a can, the operator may easily remove the can 44, 64 by lifting it up and away from the shelf 20.

It can be seen that the objects of the invention have been satisfied by the techniques and apparatus presented hereinabove. While in accordance with the patent statute, only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A paint colorant dispensing station, comprising:

a base;

mounting means connected to and extending from said base;

a shelf rotatably connected to said mounting means;

said shelf comprising a first platform and a second platform;

said shelf rotatable between a first position and a second position;

said first platform being substantially horizontal at said first position and said second platform being substantially horizontal at said second position;

said second platform being substantially wider than said first platform;

a dispensing head disposed above said shelf;

first and second stops interposed between said base and said shelf; and locking means for selectively restraining said shelf against rotation at said first and second positions.

2. A paint colorant dispensing station according to claim 1, wherein said mounting means comprises a pair of brackets and further comprising pivot means for rotatably connecting said shelf to said pair of brackets.

3. A paint colorant dispensing station according to claim 1, wherein said locking means comprises a bar pivotly mounted to said base and selectively connectable to said shelf whereby said shelf is restrained against rotation while said bar is connected to said shelf.

4. A paint colorant dispensing station according to claim 1, wherein said second platform has stiffening means for providing strength to said second platform.

5. A paint colorant dispensing station according to claim 1, wherein each of said stops is adjustable.

6. A paint colorant dispensing station according to claim 1, wherein each of said platforms is disposed below said dispensing head when each of said platforms is horizontally disposed.

7. A paint colorant dispensing station having a colorant dispensing head and an adjustable shelf maintained beneath the dispensing head, the adjustable shelf comprising:

first and second platforms, each of said platforms adapted for receiving and for supporting a paint can;

third and fourth platforms, said first, second, third and fourth platforms connected to form a tube having a quadrilateral cross section;

a pair of bracket means for rotatably supporting said platforms;

first and second stops, each of said stops mounted such that the rotation of said shelf is restrained between two positions; and locking means for selectively restraining said platform against rotation.

8. An adjustable shelf according to claim 7, wherein said platforms are further connected by a pair of end walls, each of said end walls being perpendicularly disposed to each of said platforms.

9. An adjustable shelf according to claim 8, wherein said locking means selectively connects at least one of said end walls.

10. An adjustable shelf according to claim 7, wherein said first and second stops are adjustable.

11. An adjustable shelf according to claim 10, wherein each stop comprises a head connected to a threaded rod, said threaded rod meshingly engaging a pair of nuts.

12. An adjustable shelf according to claim 7, wherein one of said platforms is substantially wider than another of said platforms.

13. An adjustable shelf according to claim 12, wherein said wider platform has stiffening means attached thereto for strengthening said platform.

14. An adjustable shelf according to claim 7, wherein one of said platforms is substantially horizontal at one of said two positions, and the other of said platforms is substantially horizontal at the other of said two positions.

* * * * *